US007552819B2

(12) United States Patent
Fernandes

(10) Patent No.: US 7,552,819 B2
(45) Date of Patent: Jun. 30, 2009

(54) PAINT ROLLER HOLDER

(76) Inventor: Joseph Francis Fernandes, 17485 NW. 67 Ct. 21 A, Hialeah, FL (US) 33015

( * ) Notice: Subject to any disclaimer, the term of this patent is extended or adjusted under 35 U.S.C. 154(b) by 0 days.

(21) Appl. No.: 12/024,700

(22) Filed: Feb. 1, 2008

(65) Prior Publication Data

US 2008/0210578 A1 Sep. 4, 2008

Related U.S. Application Data

(63) Continuation-in-part of application No. 11/203,866, filed on Aug. 15, 2005.

(51) Int. Cl.
*A45D 44/18* (2006.01)
*B65D 83/10* (2006.01)
*A47G 29/00* (2006.01)

(52) U.S. Cl. ..... 206/15.3; 206/361; 248/688

(58) Field of Classification Search ..... 206/361, 206/362, 362.3, 15.2, 15.3, 1.7; 248/146, 248/671, 688; 15/257.06; 401/126, 129
See application file for complete search history.

(56) References Cited

U.S. PATENT DOCUMENTS 1,597,548 A * 8/1926 Sharp ..... 211/74
2,399,647 A * 5/1946 Lockwood ..... 248/105
3,286,969 A * 11/1966 Frescobaldi ..... 248/688
5,178,274 A 1/1993 Long
5,915,552 A * 6/1999 Kim et al. ..... 206/361
5,992,617 A 11/1999 Couch et al.
6,041,919 A 3/2000 Adams
6,050,408 A 4/2000 Testa
6,105,816 A 8/2000 Shea
6,910,576 B2 6/2005 McGrath et al.
2004/0188276 A1 9/2004 Petrehn

* cited by examiner

*Primary Examiner*—Mickey Yu
*Assistant Examiner*—Melissa L Lalli
(74) *Attorney, Agent, or Firm*—Laurence A. Greenberg; Werner H. Stemer; Ralph E. Locher

(57) ABSTRACT

A paint roller holder for holding a roller sleeve attached to a roller frame. The roller holder has a body having an opening configured for receiving the roller sleeve and for allowing the roller sleeve to be placed inside the body. The body has a cutout configured to circumferentially seal a portion of the roller frame. A support cradle is disposed on the body and is configured for supporting the roller frame and preventing the roller sleeve from contacting an interior of the body. A closure seals the opening of the body for preventing hardening of paint on the sleeve.

14 Claims, 5 Drawing Sheets

FIG. 1
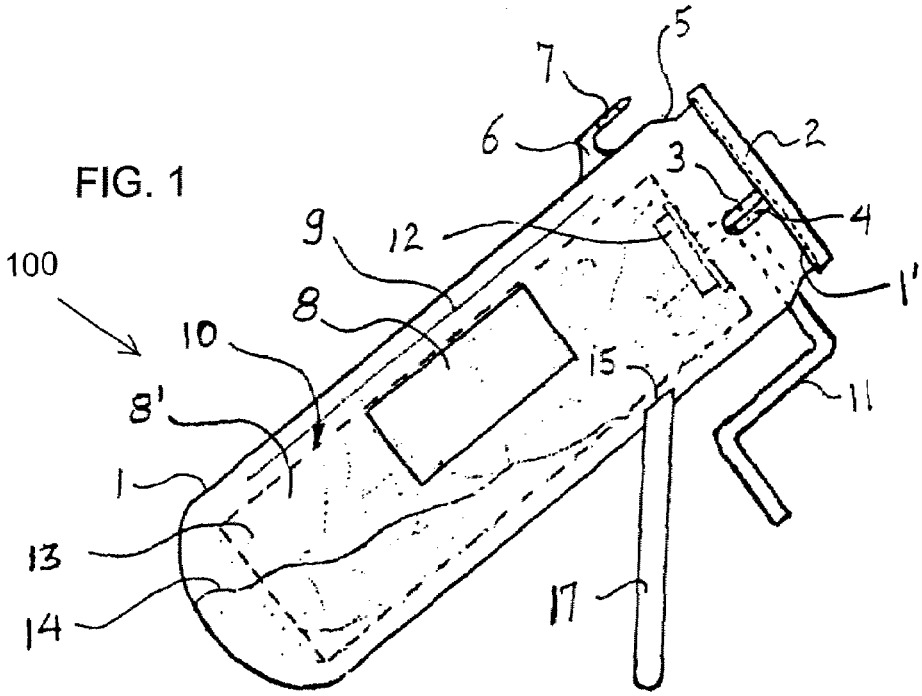
FIG. 2
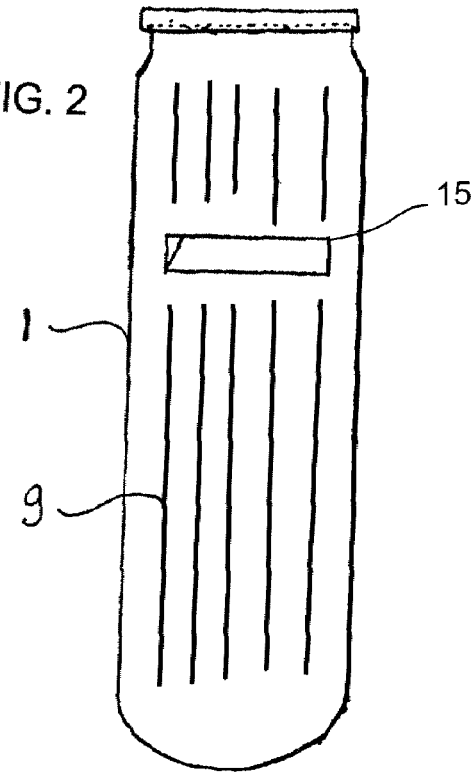
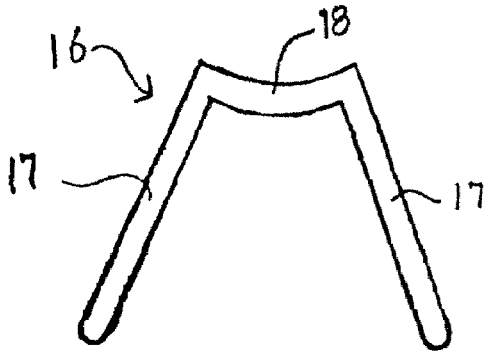
FIG. 3

PAINT ROLLER HOLDER

CROSS-REFERENCE TO RELATED APPLICATION

This application is a continuation-in-part application of U.S. patent application Ser. No. 11/203,866, filed Aug. 15, 2005, which application is hereby incorporated herein by reference.

BACKGROUND OF THE INVENTION

1. Field of the Invention

The invention relates to a paint roller holder.

2. Description of the Related Art

Typical paint rollers have a frame with a crank-shaped handle and a sleeve with a paint-carrying surface of absorbent material used to carry paint from a tray to a surface to be painted. When painting is finished before a period of non-use of the roller, such as at the end of the workday, the sleeve must be thoroughly cleaned of all paint before putting the paint roller away. Otherwise, the paint will harden on the sleeve, rendering the sleeve useless for further painting. If the painter intends to continue painting with the same paint after the period of non-use, such as during the next day, time spent in cleaning of the sleeve represents a costly loss of productivity and unnecessary waste of paint that is removed from the roller.

Containers for storing painting implements are known in art. Couch et al. (U.S. Pat. No. 5,992,617) discloses a foam insert contacting the painting implement to prevent its drying out while submerging the painting implement in paint. Most paint roller implements (frames) have metallic washers that lock the frame roller portion (the part that roller cover fits onto) to the frame handle portion. These handle portions are usually polished chrome plating over some type of metallic substrate. The chrome plating wears very quickly and exposes the metallic substrate. While the roller attached to the roller frame and is submerged, the exposed substrate and the metallic washers are introduced into the paint material. This in turn contaminates the paint with corrosion, which results in graying on the surface due to spinning the roller while the implement is in operation; or simple put, metallic gray lines while rolling the paint material onto the wall is visibly seen in white to light colors.

Other storage devices hold a roller that is removed from a roller frame. These devices include supports inside the storage devices, which engage the roller cover. While this type of construction may prevent the frame from coming into contact with the paint stored inside the device, the supports holding the roller cover leave impressions in the roller cover. The impressions in turn cause the roller cover to apply paint to a surface in an uneven manner, thereby adversely affecting the quality of the painted surface.

SUMMARY OF THE INVENTION

It is accordingly an object of the invention to provide a paint roller holder, which overcomes the hereinafore-mentioned disadvantages of the heretofore-known devices of this general type and which permits a painter to put a roller away for the evening or other period during which the roller will not be used, after not cleaning the roller, and yet permit the roller to be used again after the period of non-use is over.

With the foregoing and other objects in view there is provided, in accordance with the invention a paint roller holder for holding a roller sleeve attached to a roller frame. The roller holder has a body having an opening configured for receiving the roller sleeve and for allowing the roller sleeve to be placed inside the body. The body has a cutout configured to circumferentially seal a portion of the roller frame. A support cradle is disposed on the body and is configured for supporting the roller frame and preventing the roller sleeve from contacting an interior of the body. A closure seals the opening of the body for preventing hardening of paint on the sleeve.

In accordance with another feature of the invention, the support cradle has a channel configured to receive and securely hold a section of the roller frame.

In accordance with a further feature of the invention the paint roller holder includes a stand for maintaining said body in an inclined position.

In accordance with an added feature of the invention, the stand has a ring and legs mounted on said ring, said ring is constructed to mate to an outer circumference of said body.

In accordance with an additional feature of the invention the support cradle is mounted on said ring.

In accordance with a concomitant feature of the invention, the body has a circumferential ledge and a protrusion at said ledge, said ring has an edge engaging said ledge for setting an axial position of said stand relative to said body and a notch engaging said protrusion for setting a radial orientation of said stand relative to said body.

In accordance with yet another feature of the invention, the closure is a removable lid covering and sealing said opening of said body. The lid is connected to said ring by a flexible hinge. The lid includes a cutout which is configured to align with said slot when said lid is disposed on said body.

In accordance with yet a further feature of the invention the paint roller holder includes a seal disposed in said slot configured to circumferentially seal a portion of the roller frame.

In accordance with yet an added feature of the invention, the paint roller holder includes an extension tab disposed on said ring for suspending said body.

In accordance with yet an additional feature of the invention, the extension tab has a slot formed therein for attaching a strap or a hook.

In accordance with still yet a further feature of the invention the body has a flange and said lid has a relieved portion which is configured to seal against said flange.

In accordance with still yet another feature of the invention, the lid has a bulge portion which is configured to deflect said flange and to lock said flange into said relieved portion.

In accordance with still yet an added feature of the invention, the lid has a top portion configured to seat against a top of the body.

In accordance with still yet an additional feature of the invention, the lid has a center panel with a section configured to seal against an inside diameter of the body.

In accordance with another concomitant feature of the invention, the body has a region for receiving indicia.

In accordance with an additional concomitant feature of the invention, the body is cylindrical.

Other features which are considered as characteristic for the invention are set forth in the appended claims.

Although the invention is illustrated and described herein as embodied in a paint roller holder, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of the specific embodiment when read in connection with the accompanying drawings.

BRIEF DESCRIPTION OF THE DRAWINGS

FIG. 1 is a diagrammatic, side-elevational view of a paint roller holder according to the invention;

FIG. 2 is a front-elevational view of the paint roller holder shown in FIG. 1;

FIG. 3 is a front-elevational view of a stand for the paint roller holder;

DESCRIPTION OF THE PREFERRED EMBODIMENTS

Figures 4, 7:
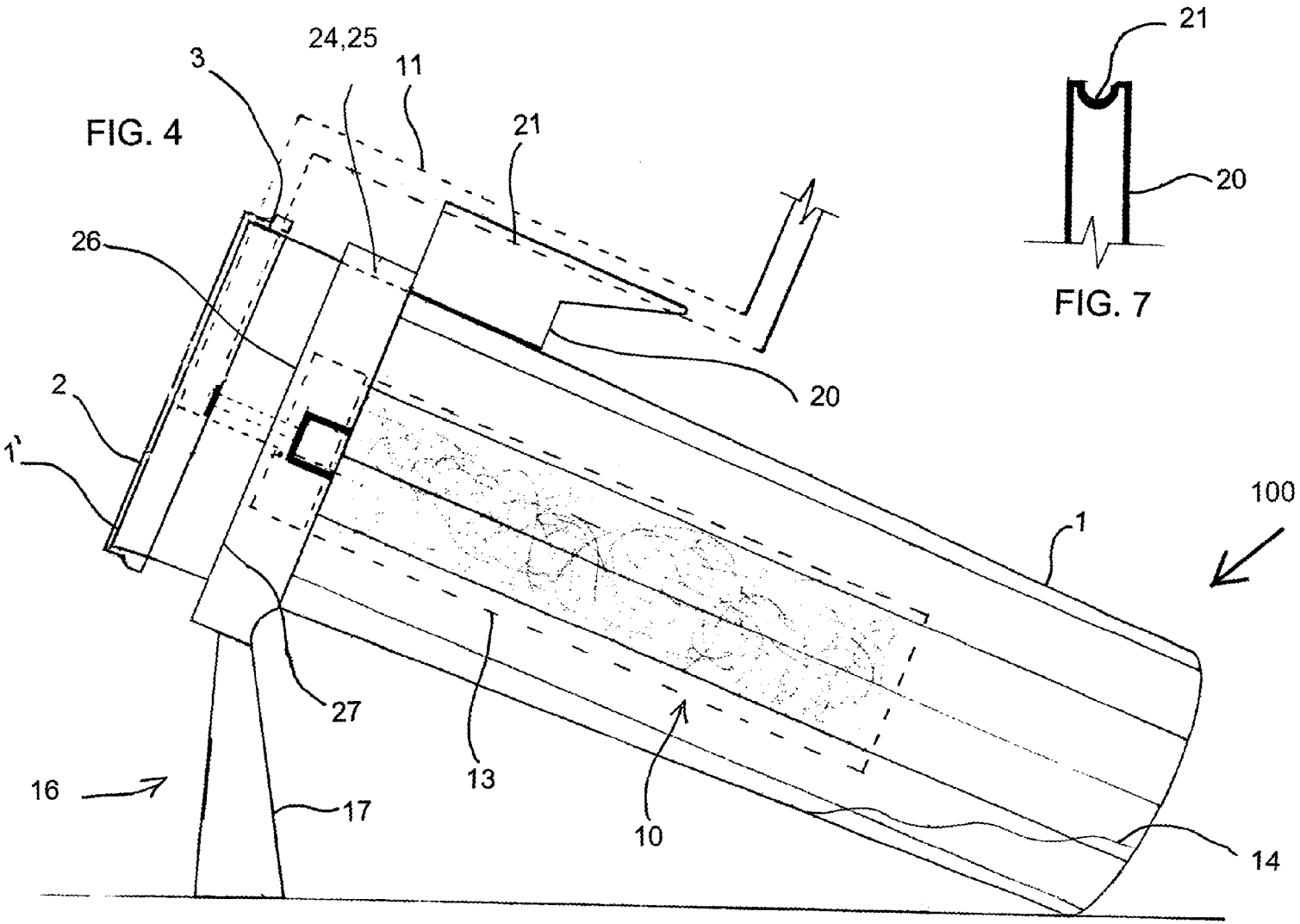
FIG. 4 is a diagrammatic, side-elevation view of another embodiment of a paint roller holder according to the invention.
FIG. 7 is a partial end view of a cradle spacer of the roller holder according to the embodiment of FIG. 4.

Referring now to the figures of the drawings in detail and first, particularly, to FIG. 1 thereof, there is seen a paint roller holder 100 having a generally cylindrical body 1 which has one open end 1'. The open end, shown at the upper right of the figure, has a raised lip and is closed by a reusable lid or cover 2. Broken lines may be seen within the cover indicating the top of the open end 1' of the body 1. However, threads may be provided by which the lid is screwed onto the body. A snap-on lid, a hinged lid or any other suitable airtight and liquid-tight closure may be used. The body 1 also has an offset 5 near the open end 1' for ease of gripping for removal of the lid.

A slot or cutout 3 provided at the open end 1' of the body 1 is substantially U-shaped and is filled by a handle seal 4 which is a U-shaped piece of rubber in the illustrated embodiment. However, any other suitable airtight and liquid-tight seal may be used. An extension tab 6 is attached to the body 1 toward the open end 1' thereof. The extension tab 6 has a slot 7 formed therein for a strap or a hook to facilitate hanging of the paint roller holder for storage. The body also has a recess 8 formed therein for application of a retailer's name and/or paint specification. Below the recess 8 is an area 8' for indicating the paint applicator type. Ribs 9 are formed in the outer surface of the body to prevent slipping when grabbing the body 1. Only one rib 9 is shown in FIG. 1 so as not to obscure other features of the device, but it is understood that ribs may be placed all around the body, if desired, as shown in FIG. 2.

A paint roller 10 has been inserted inside the body 1 for storage. The paint roller 10 has a frame including a crank-shaped handle 11. The handle 11 passes through the seal 4 and supports an insert 12 which in turn supports a core of a roller sleeve or cover 13. The sleeve 13 has a paint-carrying surface of absorbent material used to carry paint from a non-illustrated tray to a surface to be painted. The roller sleeve 13 is placed in the body 1 of the holder 100 while still wet and carrying some paint, as indicated by a level 14 of paint which has settled within the body 1. The cylindrical body 1 is configured to be of a diameter so as to accept a roller cover 13 and provide clearance around the circumference of the roller. The cylindrical body 1 is configured to be of a length that accepts the roller cover 13 and a portion of the frame 11. The lid 2 prevents hardening of paint on the paint-carrying surface of the paint roller 10, even though the handle 11 remains outside the body.

FIG. 2 shows that a recess or slot 15 is cut into the body 1. The recess 15 has a curved shape due to the curved shape of the cylindrical body 1 in which it is formed. The recess is slightly upwardly angled toward the open end 1' of the body 1. A bipod stand 16 shown in FIG. 3 has two legs 17 and a member in the form of a crosspiece 18 connected therebetween. The crosspiece 18 is curved for insertion into the curved recess 15. The crosspiece 18 has outer dimensions corresponding almost exactly to those of the recess 15 so that the crosspiece 18 may be pushed into the recess 15 and be retained tightly therein. It is understood that the stand 16 need not hold the body 1 in the position shown in FIG. 1. Instead, the recess 15 and the stand 16 may be lower down on the body 1, that is further away from the open end 1', so that the body is in a more vertical position. Two stands 16 each engaged in a respective slot 15 on opposite sides of the body may also be used so the body is completely vertical.

The body 1, lid 2, extension tab 6 and stand 16 are preferably formed of plastic material. However, any other at least somewhat rigid material, such as metal or cardboard, could also be used.

FIG. 4 shows another embodiment of the paint roller holder 100. FIG. 4 shows a support cradle or spacer 20 that is provided on the exterior of the paint roller holder 100. The support cradle 20 is configured to engage and support the frame 11 of the paint roller 10. The frame 11 is rigidly held in place by the support cradle 20, this prevents the roller sleeve 13 from coming into contact with the circumferential interior wall of the paint roller holder 100 when the roller sleeve 13 is disposed inside of the paint roller holder 100. This provides the distinct advantage that the roller sleeve 13 is not compressed during storage, thereby preventing an undesirable distortion of the roller sleeve 13. The support cradle 20 also supports the frame 11 so that area where the metallic washers that lock the frame roller portion does not contact paint 14 in the cylindrical body. This prevents graying on the painted surface when the roller is used again. The support cradle 20 may also be provided with a profiled channel 21 configured to correspond to the diameter of the frame. The channel 21 receives the frame 11 of the paint roller 10 and securely holds it in place. The channel 21 may be dimensioned so as to have a snap fit with the frame 11, or the channel 21 may include dimples or nubs 210 for creating a snap fit with the frame 11.

Figure 5:
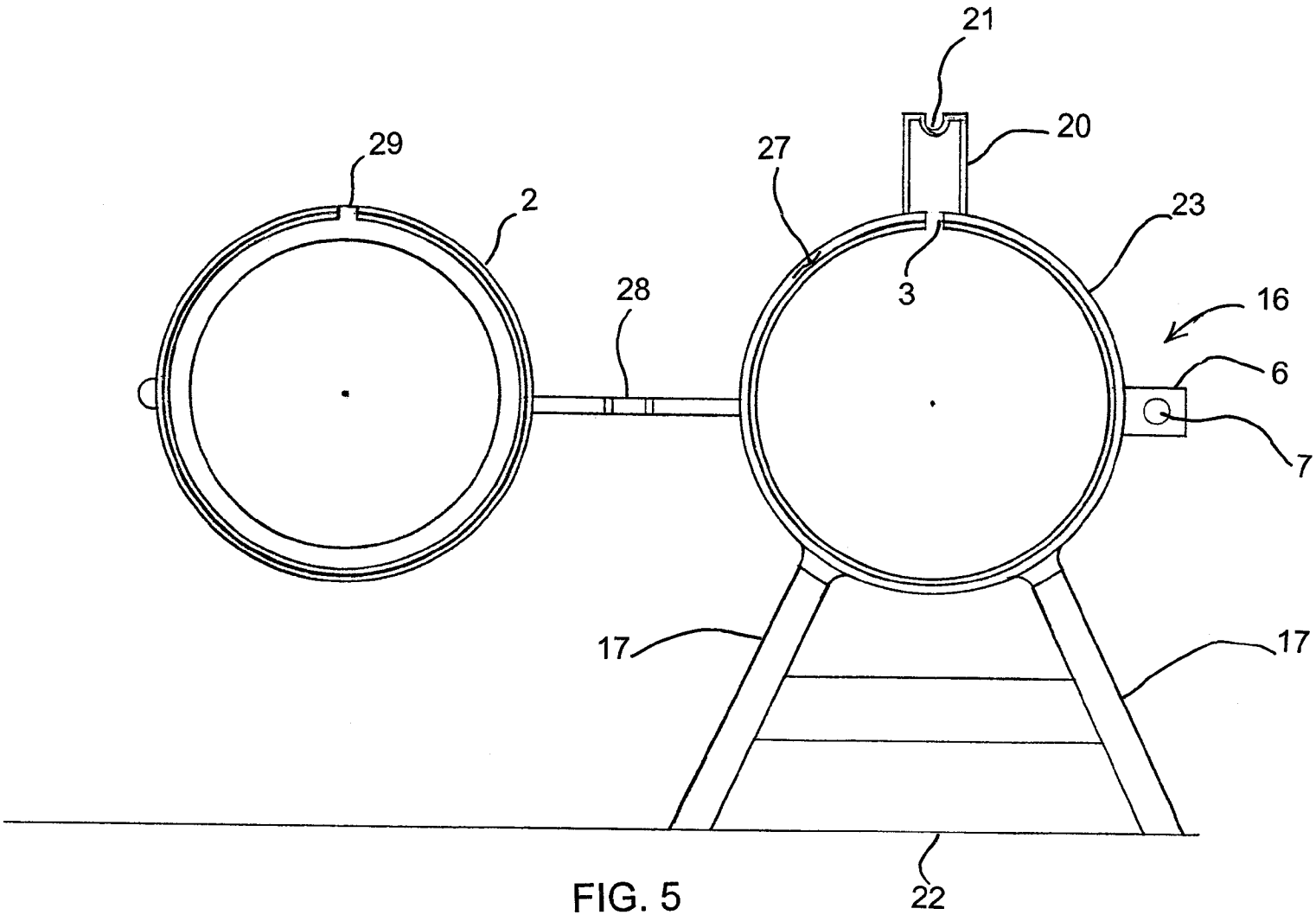
FIG. 5 is a front-elevation view of a stand with the body for the paint roller holder according to the embodiment of FIG. 4.
Figure 6:
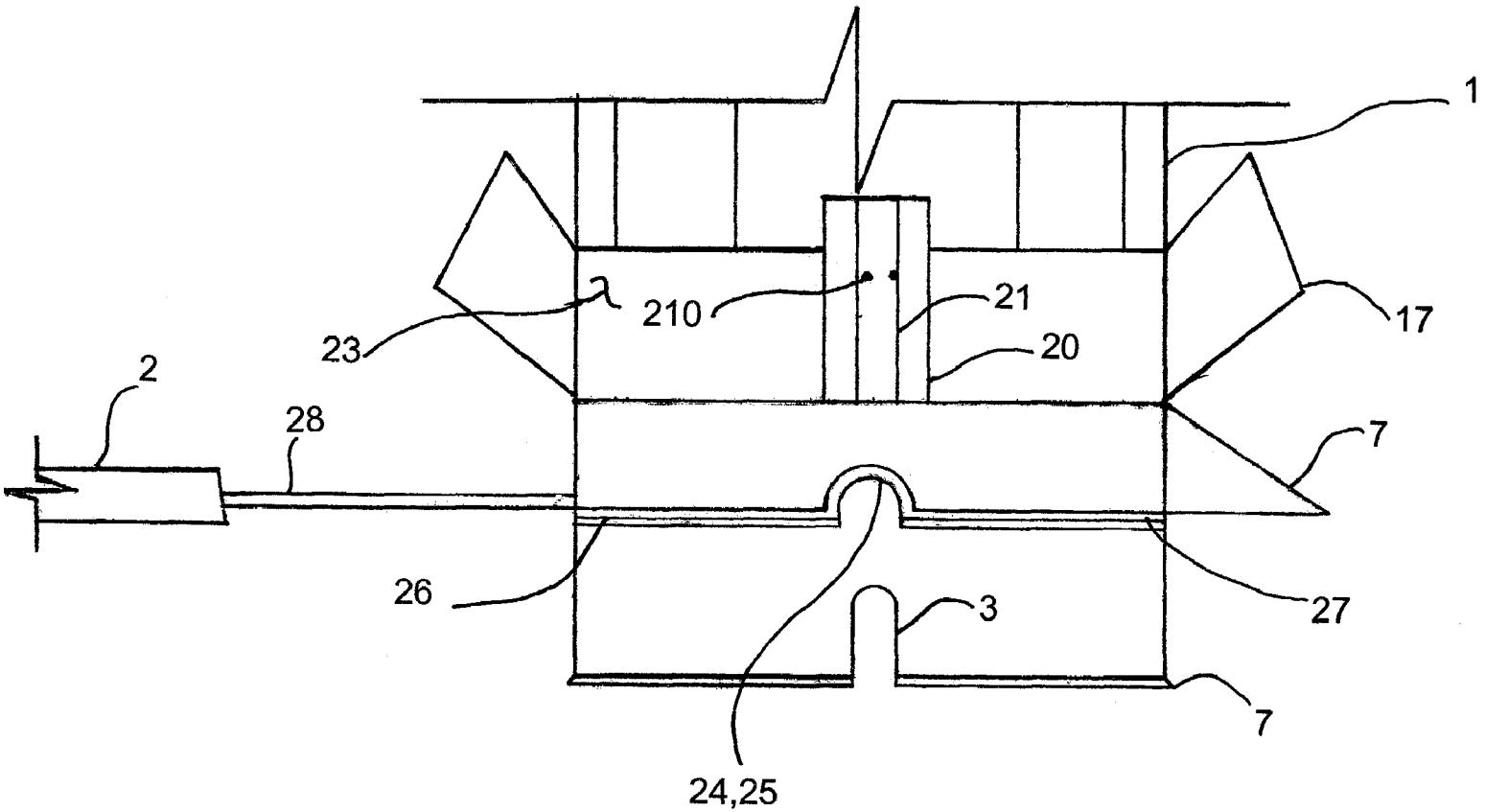
FIG. 6 is a diagrammatic, partial top view of the body of the roller holder according to the embodiment of FIG. 4.

FIG. 4 includes a stand 16 having additional features. As seen in FIG. 5, the stand 16 has a cross-member 22 which reinforces the legs 17 of the stand for preventing the legs 17 from deflecting when a loaded paint roller 10 and paint 14 are disposed inside the paint roller holder 100. The stand 16 also has a ring 23 on which the legs 17 are disposed. The ring 23 is configured to slide onto the cylindrical body 1 and mate with the outside diameter of the cylindrical body 1 for attaching the stand 16 to the cylindrical body 1. The support cradle 20 may be a part of the ring 23. The ring 23 has a notch 24 which corresponds to a corresponding raised protrusion 25 on the circumference of the cylindrical body 1. As shown in FIG. 6, a notch 24 is provided on the cylindrical body 1 and the protrusion 25 mates with the notch to set the radial orientation of the stand 16 relative to the body. Alternatively the protrusion can be on the body and the notch can be in the edge of the ring. Furthermore, the cylindrical body 1 has a ledge 26 to abut the ring 23 on an end or edge 27 thereof, thereby setting the axial position of the stand 16 on the cylindrical body 1 for disposing the cylindrical body in an inclined position. Also, as shown in FIG. 6. the cylindrical body has a lip 30 provided for sealing the lid 2.

Figure 8:
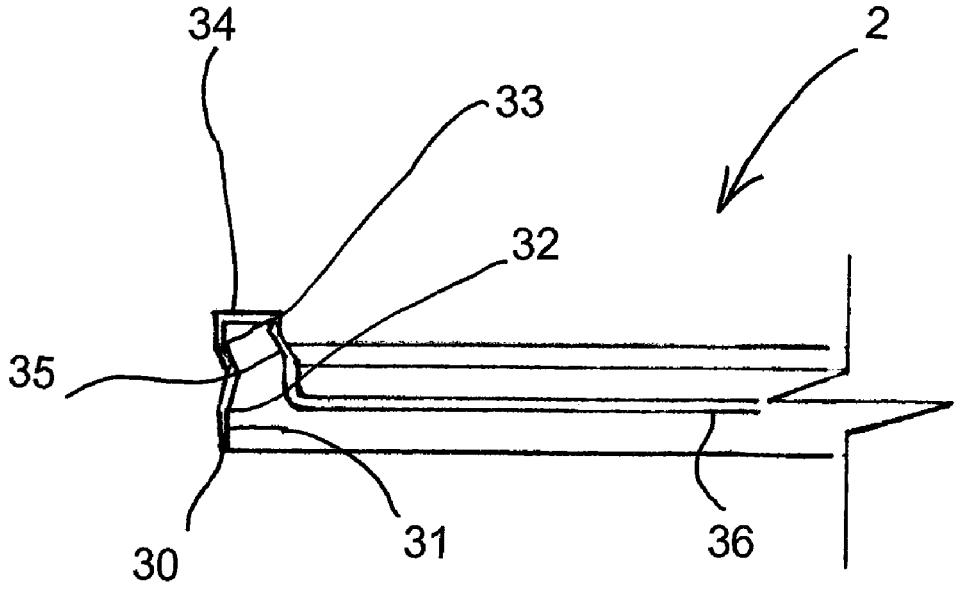
FIG. 8 is a partial enlarged section view through the edge of the lid of the roller holder according to the embodiment of FIG. 4.

FIG. 8 shows an enlarged cross-section of the edge of the lid 2, which shows how the lid 2 is constructed to seal to the cylindrical body. Beginning at the outside of the lid 2, a tapered portion 31 extends from an edge 30. The tapered portion is used to locate the lid 2 by circumferentially engaging the flange 47. The tapered portion 31 moves into a bulge portion 32 which projects inward. The bulge portion 32 deflects the flange 47. The bulge portion is followed by a relieved portion 33, which allows the flange 47 to relax once past the bulge portion 32 and create a seal between the outside diameter of the lid and the relieved portion 33 of the lid 2. The bulge portion 32 also serves to lock the flange 47 into the relieved portion 33. The relieved portion 33 moves into a transverse top portion 34. The top of the cylindrical body 1 seats against the top portion 34. The top portion 34 extends into a section 35 of a center panel 36 that engages with the inside diameter of the cylindrical body 1 and provides another sealed diameter between the lid 2 and the cylindrical body 1.

The lid 2 can be connected to the stand 16 by a hinge 28 thereby allowing the stand 16 and the lid 2 to be molded as a single part. The lid 2 includes a slot 29, which aligns with the cutout 3 in the cylindrical body. The notch 24 and the protrusion 25 assure that the slot 29 is radial aligned with the cutout 3 when the lid is placed onto the cylindrical body 1.

I claim:

1. A paint roller holder for holding a roller sleeve attached to a roller frame, comprising:

a body having an opening configured for receiving the roller sleeve and allowing the roller sleeve to be placed inside said body, said body having a cutout configured to circumferentially seal a portion of the roller frame, said body having a circumferential ledge and a protrusion at said ledge;

a support cradle disposed on said body and being configured for supporting the roller frame and preventing the roller sleeve from contacting an interior of said body;

a closure sealing said opening of said body for preventing hardening of paint on the roller sleeve; and a stand for maintaining said body in an inclined position, said stand having a ring and legs mounted on said ring, said ring being constructed to mate to an outer circumference of said body, said ring having an edge engaging said ledge for setting an axial position of said stand relative to said body and a notch engaging said protrusion for setting a radial orientation of said stand relative to said body, said support cradle being mounted on said ring.

2. The paint roller holder according to claim 1, wherein said support cradle has a channel configured to receive and securely hold a section of the roller frame.

3. The paint roller holder according to claim 1, wherein said closure is a removable lid covering and sealing said opening of said body, said lid being connected to said ring by a flexible hinge, said lid including a slot which is configured to align with said cutout when said lid is disposed on said body.

4. The paint roller holder according to claim 3, which further comprises a seal disposed in said cutout configured to circumferentially seal a portion of the roller frame.

5. The paint roller holder according to claim 3, which further comprises an extension tab disposed on said ring for suspending said body.

6. The paint roller holder according to claim 5, wherein said extension tab has a further slot formed therein for attaching a strap or a hook.

7. The paint roller holder according to claim 3, wherein said body has a flange and said lid has a relieved portion which is configured to seal against said flange.

8. The paint roller holder according to claim 7, wherein said lid has a bulge portion which is configured to deflect said flange and to lock said flange into said relieved portion.

9. The paint roller holder according to claim 8, wherein said lid has a top portion configured to seat against a top of said body.

10. The paint roller holder according to claim 9, wherein said lid has a center panel with a section configured to seal against an inside diameter of said body.

11. The paint roller holder according to claim 1, wherein said body has a region for receiving indicia.

12. The paint roller holder according to claim 1, wherein said body is cylindrical.

13. A paint roller holder for holding a roller sleeve attached to a roller frame, comprising: a body having an opening configured for receiving the roller sleeve and allowing the roller sleeve to be placed inside said body, said body having a cutout configured to circumferentially seal a portion of the roller frame, said body having a circumferential ledge and a protrusion at said ledge; a support cradle disposed on said body and being configured for supporting the roller frame and preventing the roller sleeve from contacting an interior of said body; a closure sealing said opening of said body for preventing hardening of paint on the roller sleeve; and a stand for maintaining said body in an inclined position, said stand having a ring and legs mounted on said ring, said ring being constructed to mate to an outer circumference of said body, said ring having an edge engaging said ledge for setting an axial position of said stand relative to said body and a notch engaging said protrusion for setting a radial orientation of said stand relative to said body.

14. The paint roller holder according to claim 13, wherein said support cradle has a channel configured to receive and securely hold a section of the roller frame.

* * * * *